US006550287B1

(12) United States Patent
Sherrill

(10) Patent No.: US 6,550,287 B1
(45) Date of Patent: Apr. 22, 2003

(54) METHOD OF FABRICATING SHIRTS FROM CIRCULARLY KNITTED FABRIC AND SHIRTS PRODUCED THEREBY

(75) Inventor: Keith Sherrill, Charlotte, NC (US)

(73) Assignee: Speizman Industries, Inc., Charlotte, NC (US)

( * ) Notice: Subject to any disclaimer, the term of this patent is extended or adjusted under 35 U.S.C. 154(b) by 0 days.

(21) Appl. No.: 10/165,478

(22) Filed: Jun. 7, 2002

Related U.S. Application Data

(60) Provisional application No. 60/296,603, filed on Jun. 7, 2001.

(51) Int. Cl.[7] ..... A41D 9/06

(52) U.S. Cl. ..... 66/176; 66/8; 2/90; 2/113; 2/115

(58) Field of Search ..... 66/8, 17, 169 R, 66/170, 171, 175, 176, 189, 64; 2/69.5, 69, 70, 85, 102, 105, 106, 113, 115, 122, 125, 126, 139, 90; 112/416

(56) References Cited

U.S. PATENT DOCUMENTS

| | | | | | |
|---|---|---|---|---|---|
| 1,202,332 | A | | 10/1916 | Tschirgi | |
| 1,679,206 | A | | 7/1928 | Crossingham | |
| 1,890,385 | A | | 12/1932 | Karahadian | |
| 2,072,050 | A | | 2/1937 | Sharps | 2/90 |
| 2,126,186 | A | | 8/1938 | Friedland | 2/113 |
| 2,642,570 | A | | 3/1951 | Heilbronner | 2/90 |
| 2,721,327 | A | | 10/1955 | Finekl | 2/90 |
| 2,911,648 | A | | 11/1959 | Schanda-Seyferth | 2/69 |
| 3,561,009 | A | | 2/1971 | Huggins | 2/90 |
| 3,719,955 | A | | 3/1973 | Hrubecky | 2/243 |
| 3,985,003 | A | | 10/1976 | Reed | 66/196 |
| 4,095,441 | A | | 6/1978 | Robinson et al. | 66/176 |
| 4,197,724 | A | * | 4/1980 | Robinson et al. | 66/176 |
| 5,271,249 | A | * | 12/1993 | Mitsumoto et al. | 66/60 R |
| D409,358 | S | | 5/1999 | Melvin et al. | D2/828 |
| 6,330,814 | B1 | * | 12/2001 | Fujiwara | 66/8 |
| 6,389,850 | B1 | * | 5/2002 | Fujiwara | 66/176 |

* cited by examiner

*Primary Examiner*—Danny Worrell
(74) *Attorney, Agent, or Firm*—Kennedy Covington Lobdell & Hickman LLP

(57) ABSTRACT

Shirts may be fabricated with a minimal number of sewn seams utilizing a first circularly knitted fabric tube forming a shirt body and a second circularly knitted fabric tube forming shoulder portions and sleeves by orienting the tubes essentially transversely to one another and sewing one axial end of the tubular fabric of the shirt body to a side portion medially along the length of the tubular fabric of the shoulders and sleeves.

11 Claims, 3 Drawing Sheets

METHOD OF FABRICATING SHIRTS FROM CIRCULARLY KNITTED FABRIC AND SHIRTS PRODUCED THEREBY

CROSS-REFERENCE TO RELATED APPLICATION

This application is entitled to the benefit of, and claims priority to, provisional U.S. Patent Application Ser. No. 60/296,603 filed Jun. 7, 2001 and entitled "METHOD OF FABRICATING SHIRTS FROM CIRCULARLY KNITTED FABRIC AND SHIRTS PRODUCED THEREBY" the entirety of which is hereby incorporated by reference.

BACKGROUND OF THE INVENTION

The present invention relates generally to the fabrication of wearing apparel and, more particularly, to the construction of shirts and methods for producing the same, especially shirts fabricated from knitted fabrics.

As is well known, virtually all shirts, whether formal or informal and whether made of woven, knitted or other fabric, are produced by a so-called cut-and-sewn methodology wherein individual fabric pieces are cut from the selected fabric and then sewn together into a configuration forming a shirt body for covering a wearer's torso and sleeves for covering the wearer's arms. Necessarily, this cut-and-sewn process produces a number of individual seams in the resultant garment, typically including at least seams along each shoulder, vertical seams along one or both sides of the torso portion of the shirt body, seams encircling each arm at the juncture with the shirt body, and seams providing a finished edge to the various openings (e.g., the neck, arm and waist openings) in the garment. This process is highly labor intensive and, in turn, adds a greater element of expense to the cost of producing the garment than the fabric itself. In addition, seams tend to be weaker and, hence, more subject to separation, tearing or other damage, than unseamed portions of the fabric from which the shirt is made.

Accordingly, there is a need and desire within the apparel industry to provide shirts in which seams are minimized so as to reduce the cost of manufacture and also improve the overall strength and durability of the garment, particularly garments such as sports jerseys which must endure more rigorous conditions of use and abuse than other types of shirts.

SUMMARY OF THE INVENTION

It is accordingly an object of the present invention to provide a novel method of fabricating shirts in general by which the formation of seams is minimized. A more particular object of the present invention is to employ circularly knitted fabrics in such process. Another object of the present invention is to provide a methodology of fabricating shirts which may be applicable in various embodiments to many different types of shirt garments, but the present invention seeks to provide in one particular embodiment a methodology specifically applicable to the fabrication of sports jerseys, especially football jerseys. A still further specific object of the present invention is to provide a method of fabricating shirts which eliminates the seams normally formed in conventional cut-and-sewn shirts at the top of the shoulders, between the shirt body and the sleeves, and along one or both sides of the shirt body. It is additionally an object of the present invention to provide a novel structure of shirt as a result of the methodology of the invention.

Basically, the present invention utilizes two lengths of circularly knitted tubular seamless fabric, one of which will form the body of the shirt and the other of which will form the shoulders and sleeves. The fabric tube which will form the body of the shirt is knitted to a diameter and predetermined length suitable for the shirt body, with the lower end of the fabric being formed with a turned welt to form a folded finished annular edge defining the waist opening of the shirt body and with the upper end of the fabric tube left with an unfinished edge for sewing to the other fabric tube which will form the shoulders and sleeves. This latter fabric tube for forming the shoulders and sleeves is similarly knitted (either on the same or a different knitting machine) to a predetermined length (depending upon the size of the garment and whether the sleeves will be short, mid-length or long sleeves), with each opposite end of the tube formed with a turned welt to form a folded finished edge defining the arm openings in the shirt.

The present method basically forms the garment by orienting the shoulder/sleeve tube perpendicularly with respect to the upper end of the body tube and sewing the two tubes together. The shoulder/sleeve tube is cut appropriately in preparation for this sewing operation, which cutting may be performed in differing ways according to how the shoulders and sleeves are to be sized and shaped. For example, in a simplified embodiment, the shoulder/sleeve tube may be slit axially along only an intermediate length of the tube sufficient to be sewn along the upper unfinished annular edge of the body tube, but otherwise leaving the sleeves seamless. Alternatively, the shoulder/sleeve tube may be slit axially along its entire length, following which the resultant cut edges are sewn midway along their length to the upper annular edge of the body tube and the cut edges of the shoulder/sleeve tube extending outwardly beyond either side of the body tube are then sewn together, e.g., taperingly, to shape and size the sleeves. A neck opening is also cut in the shoulder/sleeve tube opposite the side thereof sewn to the body tube, and a neck band is sewn along this opening to form a finished neck to the garment.

Advantageously, the above-described process results in the complete elimination of any seam along the top of the shoulders of the garment, any seam encircling the sleeves, and any seam along the sides or otherwise along the length of the shirt body.

DETAILED DESCRIPTION OF THE PREFERRED EMBODIMENT

Figure 1:
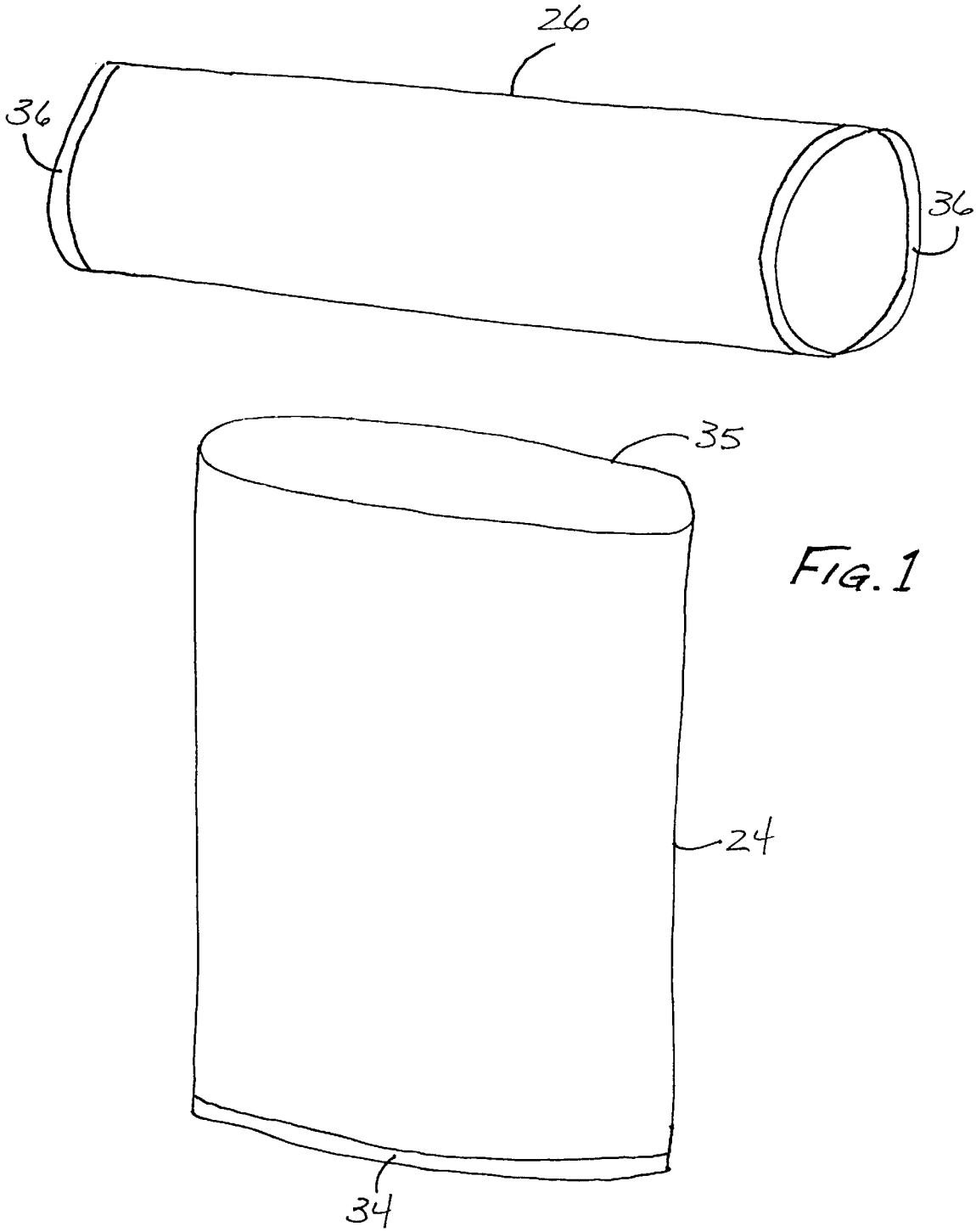
FIGS. 1, 2 and 3 depict schematically the sequence of steps under the present invention in fabricating the shirt of the present invention, according to one possible embodiment contemplated for the fabrication of football jerseys.

Referring now to the accompanying drawings, a football jersey produced according to the method of the present invention is depicted in a simplified schematic perspective view and is indicated as a whole at 10. However, while the present invention is herein described and illustrated in relation to this particular embodiment, it will be readily recognized by persons skilled in the art and, accordingly, is to be expressly understood that the present invention is not limited to this particular embodiment and, more specifically, is not limited to the fabrication of football jerseys nor any other particular type of shirt garment. Many other potential embodiments of and applications for the present invention will occur to persons skilled in the art, all of which are considered and intended to be encompassed within the scope of the present invention.

Basically, the football jersey 10 (as well as any other shirt in accordance with the present invention) comprises a torso-encircling shirt body 12, shoulder portions 14 covering the tops of the wearer's shoulders, and sleeves 16 encircling the wearer's arms, with a neck opening 18 separating the opposing shoulder portions and sleeves 14, 16, arm openings 20 at the terminal ends of the respective sleeves 16, and a waist opening 22 at the terminal lower end of the shirt body 12.

In accordance with the present invention, the jersey 10 is fabricated from two lengths of circularly knitted seamless tubular fabric 24, 26, sewn together in perpendicular relation such that the fabric tube 24 forms the torso-encircling shirt body 12 and the fabric tube 26 forms the shoulder portions and sleeves 14, 16. As will be more fully explained hereinbelow, the methodology of the present invention by which the jersey 10 is fabricated produces only a seam 28 encircling the chest area of the shirt body 12 at the juncture between the upper end of the body tube 24 and the lower side of the shoulder/sleeve tube 26, optional seams 30 extending outwardly therefrom along the underside of the respective sleeves 16, and a seam 32 affixing a neck band 19 along the neck opening 18.

Figure 2:
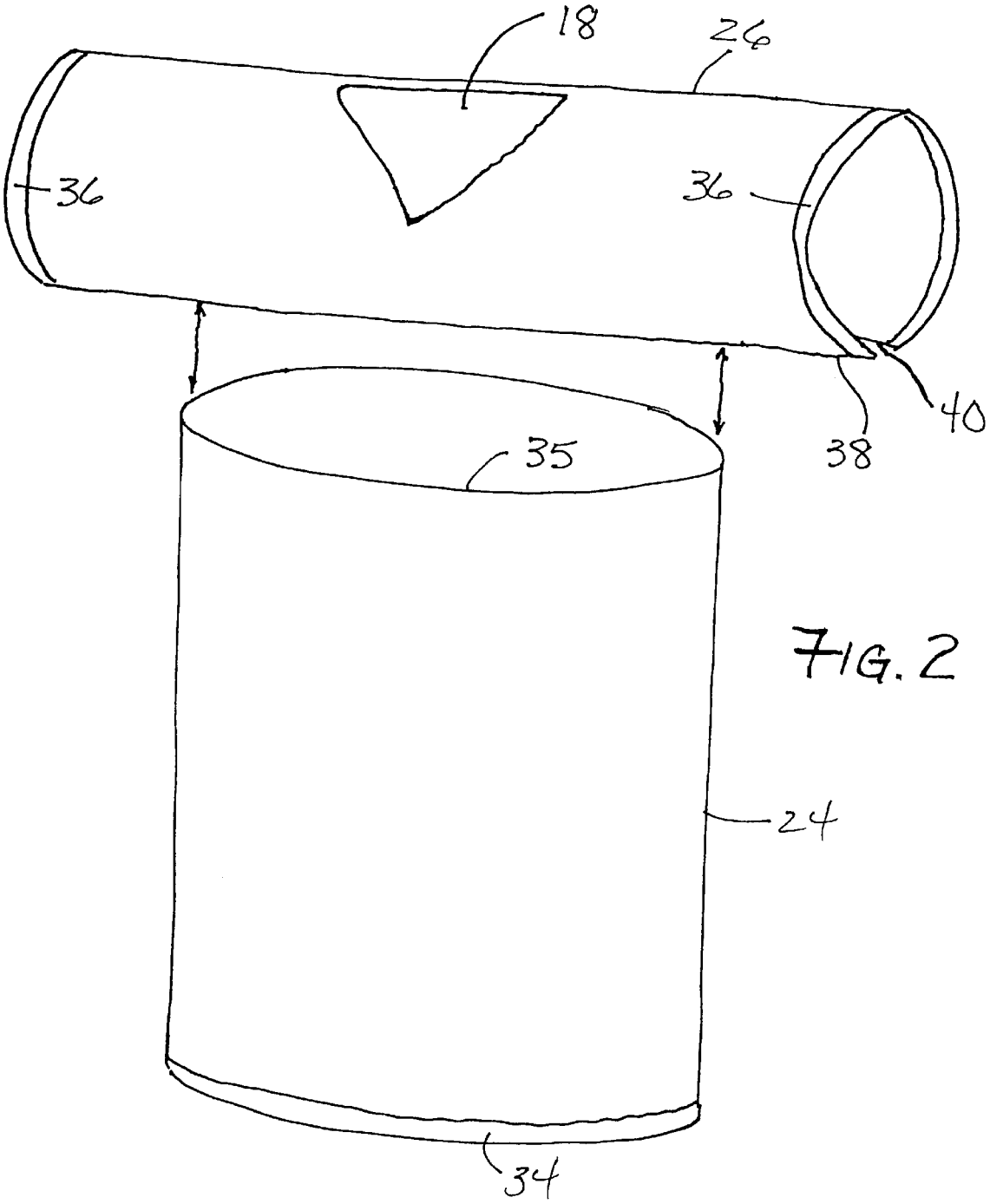
Figure 3:
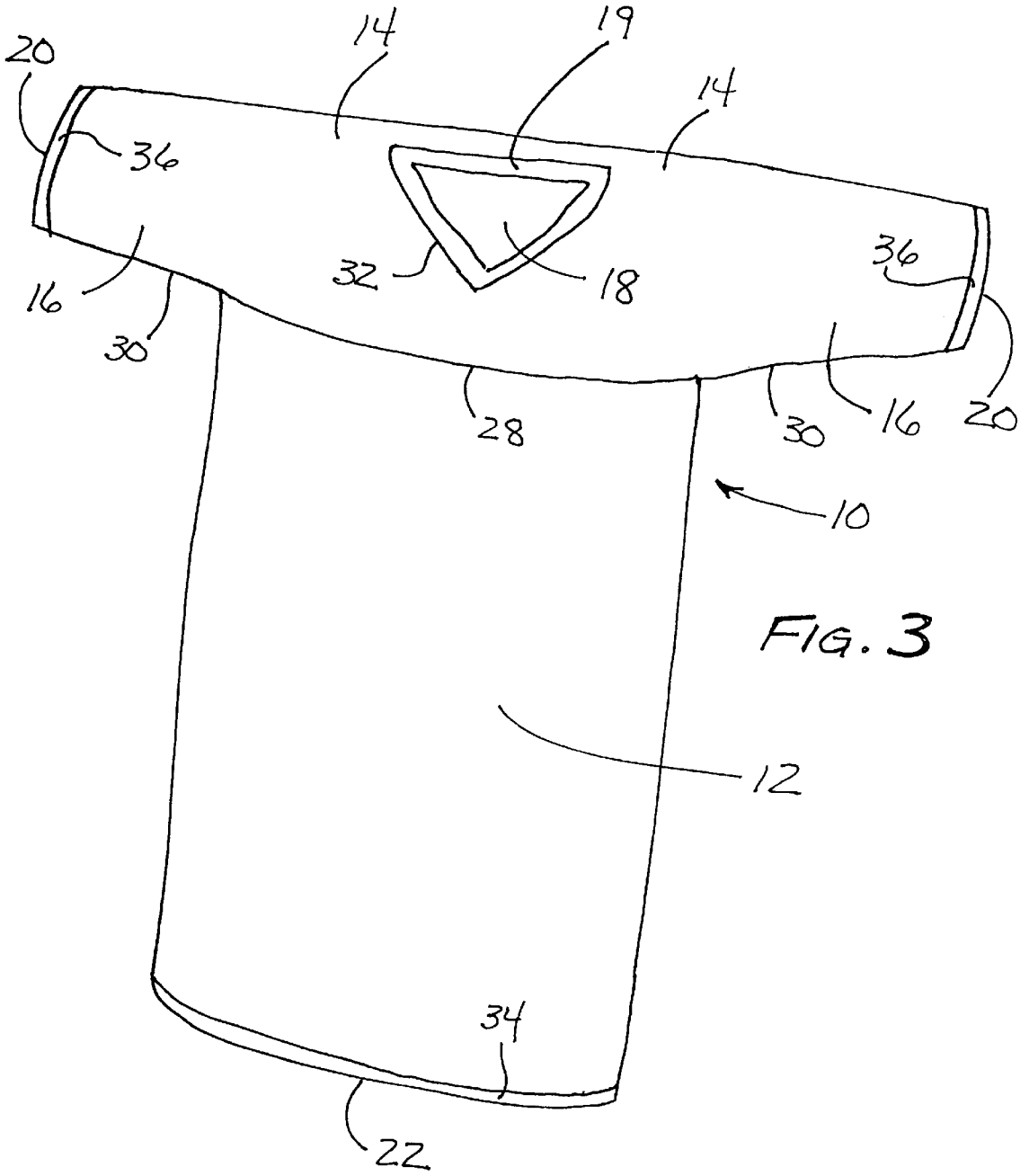

The basic methodology by which the jersey 10 of FIG. 3 is fabricated is depicted and may be understood with reference to FIGS. 1 and 2. In FIG. 1, the body tube 24 and the shoulder/sleeve tube 26 are depicted as such tubes are produced on a circular knitting machine prior to any post-knitting steps preparatory to the fabrication of the jersey 10. More specifically, the body tube 24 is circularly knitted in the form of a seamless tubular fabric of a diameter and an axial length selected to be suitable for the shirt body 12 according to the desired size of the jersey 10. One axial end of the fabric tube 24 is formed on the circular knitting machine with an annular turned welt 34 to form a folded finished edge for defining the waist opening 22, so as to eliminate the conventional necessity of finishing the waist opening by a sewing step. The opposite end of the body tube 24 is left with an unfinished annular edge for sewing to the shoulder/sleeve tube 26 as hereinafter described. The shoulder/sleeve tube 26 is similarly knitted as a seamless knitted tubular fabric of its own predetermined diameter and length suitable to form the shoulder portions 14 and the sleeves 16 of the jersey 10, with each opposite end of the shoulder/sleeve tube 26 also being formed with a turned welt 36 to form folded finished edges for the arm openings 20 so as also to eliminate the conventional necessity of finishing the arm openings by a sewing step.

As depicted in FIG. 2, the shoulder/sleeve tube 26 is prepared for sewing to the body tube 24 by initially cutting the tube axially along the entire lengthwise extent thereof, to form exposed edges 38,40 suitable for sewing to the upper end of the body tube 24. The side of the. shoulder/sleeve tube 26 opposite the resultant lengthwise edges 38, 40 is cut centrally along its length to remove a section of fabric of a size and shape to define the neck opening 18.

As those persons skilled in the art will recognize and understand, additional shaping of the cut edges 38, 40 of the shoulder/sleeve tube 26 and of the upper unfinished annular edge 35 of the body tube 24 may be performed as necessary or desirable to impart to the finished garment when subsequently sewn (as described below) any desired shaping or contouring of the jersey 10, e.g., to impart a tapered narrowing of the sleeves 16 from the shoulder portions 14 to the arm openings 20, to impose an angular contour to the shoulder portions 14, etc. However, for sake of simplicity in the illustration and description of the present invention, any such additional cutting and shaping of the fabric tubes 24, 26 preparatory to sewing thereof together to form the finished jersey 10 have not been illustrated specifically in the accompanying drawings, but nevertheless will be readily understood and appreciated by those persons skilled in the art.

Following the above-described preparatory steps, medial portions of the front and back edges 38, 40 in the underside of the shoulder/sleeve tube 26 are sewn to respective front and back segments of the upper unfinished annular edge 35 of the body tube 24, thereby forming the aforementioned chest seam 28, and the remaining extents of the cut edges 38, 40 outwardly thereof are sewn together to form the respective arm seams 30. The neck band 19 is similarly sewn about the neck opening 18, thereby completing the finished jersey 10.

As will thus be understood, the minimal number of sewn seams required to complete the finished jersey 10 provides the dual advantages of significantly reducing the labor and time required to complete a finished garment, thereby commensurately reducing the overall cost of production of the garment, while also improving the overall strength and durability of the garment by minimizing the number of seams which form weakened stress points in the garment. As a net result, the jersey 10 provides improved performance at a lower cost than comparable jerseys fabricated by a conventional cut-and-sewn process.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method of fabricating a shirt from circularly-knitted fabric, comprising the steps of:

(a) providing a shirt body tube comprised of a circularly knitted tubular seamless fabric of a predetermined length and diameter;

(b) providing a shoulder and sleeve tube comprised of a circular knitted tubular seamless fabric of a predetermined diameter and length; and (c) sewing one axial end of the shirt body tube to a side portion of the shoulder and sleeve tube at a medial location therealong.

2. A method of fabricating a shirt from circularly knitted fabric according to claim 1, further comprising the step of cutting the side portion of the shoulder and sleeve tube preparatory to sewing thereof to the one end of the shirt body tube.

3. A method of fabricating a shirt from circularly knitted fabric according to claim 1, further comprising the step of forming the other axial end of the shirt body tube with an annular turned welt.

4. A method of fabricating a shirt from circularly knitted fabric according to claim 1, further comprising the step of forming each opposite end of the shoulder and sleeve tube with an annular turned welt.

5. A method of fabricating a shirt from circularly knitted fabric according to claim 1, further comprising the step of forming a neck opening in another side portion of the shoulder and sleeve tube.

6. A method of fabricating a shirt from circularly knitted fabric according to claim 1, further comprising the step of contouring at least one of the shoulder and sleeve tube and the shirt body tube preparatory to sewing thereof.

7. A shirt comprising a torso-encircling shirt body formed of a first length of circularly knitted seamless tubular fabric, and shoulder portions and sleeves formed of a second length of circularly knitted tubular seamless fabric sewn to one axial end of the tubular fabric of the shirt body with the respective axes of the tubular fabrics oriented essentially transversely with respect to one another.

8. A shirt according to claim 7, further comprising a turned welt encircling each opposite end of the tubular fabric of the shoulder portions and the sleeves.

9. A shirt according to claim 7, further comprising an annular turned welt encircling the axial end of the tubular fabric of the shirt body opposite the tubular fabric of the shoulder portions and sleeves.

10. A shirt according to claim 7, wherein the shirt is a sports jersey.

11. A shirt produced according to the method of claim 1.

* * * * *